US005551729A

United States Patent [19]

Morgan

[11] Patent Number: 5,551,729

[45] Date of Patent: Sep. 3, 1996

[54] TAMPER INDICATION DEVICE

[76] Inventor: Brian R. Morgan, 2641 Calle del Oro, La Jolla, Calif. 92037

[21] Appl. No.: 335,631

[22] Filed: Nov. 7, 1994

[51] Int. Cl.[6] ..... B42D 15/00

[52] U.S. Cl. ..... 283/94; 283/72

[58] Field of Search ..... 283/72, 81, 94, 283/95, 96, 698, 99, 100, 101, 102; 40/299, 625, 630

[56] References Cited

U.S. PATENT DOCUMENTS

| | | | |
|---|---|---|---|
| 401,210 | 4/1989 | Reed . | |
| 2,013,299 | 9/1935 | Byrne | 292/307 |
| 2,422,314 | 6/1947 | Rheinstrom | 206/47 |
| 3,827,726 | 8/1974 | McVoy et al. | 283/7 |
| 3,854,581 | 12/1974 | Jones, Jr. | 206/460 |
| 3,983,645 | 10/1976 | Rycroft | 40/2.2 |
| 4,277,089 | 7/1981 | Lockhart | 282/27 R |
| 4,309,468 | 1/1982 | St. Aubin | 428/42 |
| 4,557,971 | 12/1985 | Williams | 428/343 |
| 4,614,363 | 9/1986 | Breen | 283/94 X |
| 4,652,473 | 3/1987 | Han | 428/35 |
| 4,837,061 | 6/1989 | Smits et al. | 283/94 X |
| 4,876,123 | 10/1989 | Rivera et al. | 283/94 X |
| 5,013,088 | 5/1991 | Marin | 283/81 |
| 5,042,842 | 8/1991 | Green et al. | 283/101 |
| 5,364,133 | 11/1994 | Hofen et al. | 283/94 X |

FOREIGN PATENT DOCUMENTS

| | | | |
|---|---|---|---|
| 2243139 | 3/1990 | United Kingdom | G09F 3/03 |

*Primary Examiner*—Willmon Fridie Jr.

*Attorney, Agent, or Firm*—Brown, Martin, Haller & McClain

[57] ABSTRACT

A tamper indicating, multi-layer strip has an upper layer of translucent or transparent material, a tamper pattern-forming layer beneath the upper layer, and a lower, adhesive layer for securing the strip to an item to be protected. A layer of imprintable material which is of area less than that of the upper layer covers part of the upper surface of the upper layer to form a signature-receiving area. The tamper pattern-forming layer is designed to be activated to reveal a tamper pattern through the upper layer when the strip is peeled away from an item to which it has been adhered. A signature is applied to the imprintable material layer prior to application of the strip to an item to be protected, making unauthorized duplication difficult, if not impossible.

12 Claims, 1 Drawing Sheet

TAMPER INDICATION DEVICE

BACKGROUND OF THE INVENTION

The present invention relates generally to indicating devices designed to provide an indication of whether an article has been used, opened, or otherwise tampered with during the owner's absence, and is particularly concerned with a tamper indicating device which may be used to secure luggage, drawers, doors, boxes, switches, telephones and other devices so that they cannot be opened or used by unauthorized individuals without leaving an immediate indication to the owners that tampering has taken place.

Tamper evident strips are known which produce some kind of visible change when peeled off an item or otherwise disturbed. Some of these strips produce an irreversible color change when adjacent layers are separated, for example. Tamper indicating labels are known which produce a visible message when tampering occurs, such as a "VOID" message. These are sometimes used for inventory control, for example. All of these strips are subject to the disadvantage that they can be removed and replaced with a new, inactivated strip if the unauthorized individual has access to a supply of such strips. This defeats the purpose of such strips or labels.

SUMMARY OF THE INVENTION

It is an object of the present invention to provide a new and improved tamper indicating device which is more resistant to attempts to defeat the purpose of the device than previous tamper indicating devices.

According to the present invention, a tamper indicating device is provided which comprises a multi-layer strip having an upper layer, an indicia-forming layer, and a lower, adhesive layer for securing the strip to an item to be protected, the upper layer including an imprintable signature area for receiving personal indicia such as a signature, and the indicia-forming layer being designed to change the appearance of the strip irreversibly if the strip is peeled off after application to an item to be protected.

In the preferred embodiment of the invention, the upper layer is of clear or translucent material and the indicia-forming area comprises a tamper pattern which is activated only when someone attempts to remove the strip after application to an item to be protected. The tamper pattern then becomes visible, providing an immediate indication of tampering. The imprintable signature area comprises a coating or layer of imprintable material on the upper layer, for example a coating of imprintable varnish.

With this invention, the tamper indicating strip cannot be defeated simply by replacing it with a new strip after activation has occurred. The user must personalize the strip by placing a signature in the signature area prior to application to an item to be protected. If someone subsequently lift or removes the strip, the tamper indicating pattern or message is activated on the strip and becomes irreversibly visible. The removed strip cannot be replaced with a new strip, since the signature cannot be duplicated on the new strip.

The strip may be provided as labels of various sizes for different applications, or in a continuous strip form with signature areas at spaced intervals, with the user cutting the strip to the desired length when needed. It may be used to reduce the risk of tampering and to provide an immediate indication if tampering has occurred, in a large variety of different situations. For example, it may be used to secure a drawer or door against unauthorized opening, to secure a suitcase, briefcase, bag or the like against opening without the owner's knowledge, to secure a telephone against unauthorized use, to secure a computer or other equipment by placing the strip across the on/off button, and in numerous other possible situations.

The strip is inexpensive and easy to personalize prior to use. Even if an unauthorized individual should gain access to a supply of such strips, they will not normally be able to duplicate the owner's signature with sufficient accuracy to remove all evidence of tampering. The user simply applies their signature immediately prior to application to the item to be protected, applies the strip to the item appropriately so that access cannot be gained without disturbing the strip, and can then be assured that any tampering occurring in the absence of the user will be immediately apparent on their return.

BRIEF DESCRIPTION OF THE DRAWINGS

The present invention will be better understood from the following detailed description of a preferred embodiment of the invention, taken in conjunction with the accompanying drawings, in which like reference numerals refer to like parts, and in which.

DESCRIPTION OF THE PREFERRED EMBODIMENT

Figure 1:
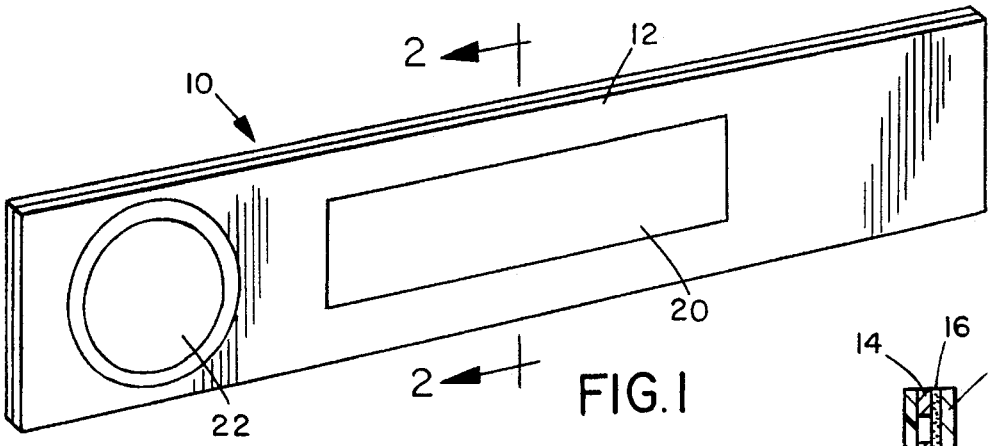
FIG. 1 is a perspective view of a preferred embodiment of the tamper indicating label of the present invention.
Figure 2:
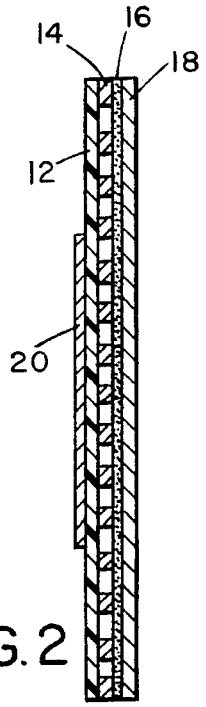
FIG. 2 is a section on the lines 2—2 of FIG. 1.

FIGS. 1 and 2 of the drawings illustrate a tamper indicating strip or label 10 according to a first embodiment of the present invention, while FIGS. 3–6 illustrate some possible uses for the strip 10. Label 10 basically comprises an upper layer 12 of transparent or translucent material such as polyester film or the like, a tamper-pattern forming layer 14 beneath layer 12, an adhesive layer 16, and a removable cover layer 18 of paper or the like. A blank, personal indicia receiving cover layer or area 20 of suitable size for receiving a person's signature is provided over a part of the upper layer 12. Since the polyester material of layer 12 is unable to receive a signature imprint, area 20 is provided by applying an imprintable medium to layer 12 over the appropriate area. In the illustrated embodiment, area 20 comprises a coating of any conventional imprintable varnish.

The tamper-pattern forming layer 14 is designed to produce an appropriate, visible tamper pattern on tampering with the strip. Thus, if the strip is adhered to a surface, the tamper pattern is activated if the strip is peeled away from the surface. The tamper indicating strip 10 may comprise 3M™ Scotchguard™ 7394 Tamper-Indicating Non-Marking Label Stock, with a coating of imprintable varnish 20 applied over part of the upper layer of the strip to provide a signature area, since the upper layer of 3M™ Scotchguard™ 7394 is incapable of receiving a signature. Alternatively, the upper, glossy layer of the 3M™ tape may be replaced with another transparent material, such as Scotch tape material, which is rough enough to receive a signature. Alternatively, other types of tamper indicating strips may be used which have the property of changing their appearance when peeled away from an item to which they have been applied. The signature area 20 may be provided on such strips in a similar manner.

Other indicia 22 may be applied to the upper layer 12 of the strip if desired, such as a logo or the like. The tamper indicating pattern may be of any suitable type, such as the word "VOID" appearing repeatedly over the label when an attempt is made to peel the label off an item after application.

Indicia or signature area 20 is preferably long enough to receive information in addition to the signature, if desired, such as the date and time of use. Area 20 extends across the center of the strip and a non-imprintable border region surrounds the area 20, including non-imprintable end portions between the opposite ends of the area 20 and the respective ends of the strip. The non-imprintable end portions are preferably of length approximately equal to the length of area 20, as illustrated. Area 20 is of length 2 to 2.5 inches and 0.5 inches height, in one example, and the end portions on each side of area 20 may also each be around 2 inches in length. This ensures that a relatively large area of the strip will change appearance if an unauthorized attempt is made to tamper with an item protected by the strip, as explained in more detail below. However, strip or labels of different sizes may be provided for protecting different size items.

Figure 3:
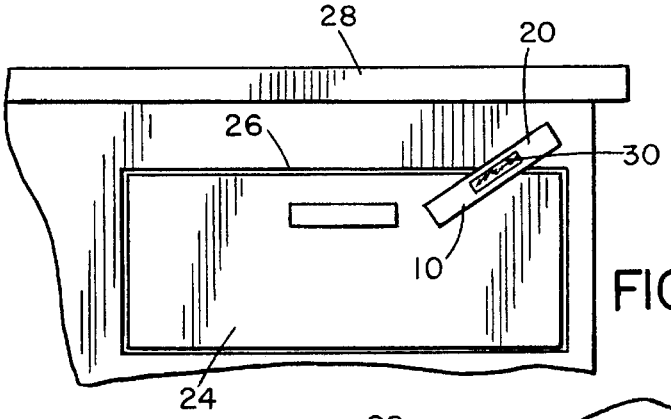
FIG. 3 is a front view illustrating one possible use of the label to secure a drawer.
Figure 4:
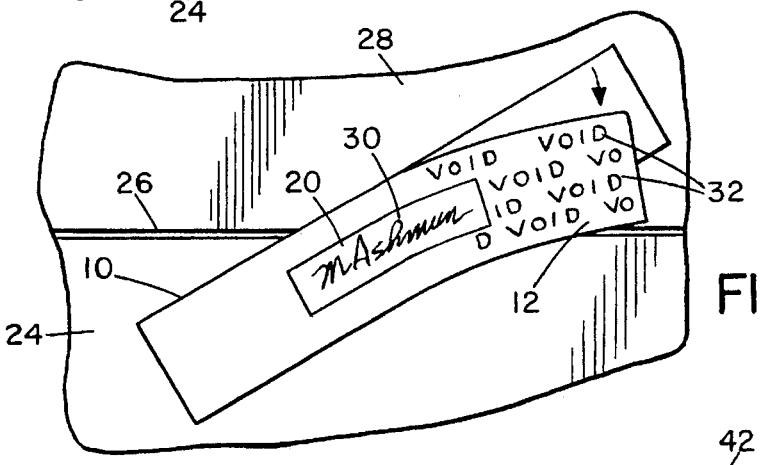
FIG. 4 is a front view of the label applied across the junction between two parts, such as the edge of the drawer and the surrounding opening in a cabinet, illustrating activation of the tamper pattern as the label is peeled away.

The tamper indicating label may be used in numerous ways to secure items against unauthorized use or opening without the owner's knowledge. FIG. 3 illustrates one possible use of the label to secure a drawer 24 in a closed position in a drawer-receiving opening 26 in a desk 28, or in a chest of drawers, cabinet or the like. The user first writes their signature 30 in area 20 of the strip, peels away backing layer 18, and then adheres the label across the edge of the drawer and opening 26, for example as illustrated in FIG. 3. No one can then open the drawer without first lifting or removing the label 10. If the label is peeled up as illustrated in FIG. 4, the tamper pattern 32, consisting of the word "VOID" in the case of the 3M strip referred to above, for example, immediately appears, leaving no visible residue on the surface to which it was applied. The label is easy to lift or peel away after application, but doing so automatically activates the tamper message. Thus, even if an attempt is made to stick the label back down after opening the drawer, it will still be apparent to the owner that the drawer has been opened. The activated label cannot be replaced with a new, inactivated label by an unauthorized individual, since they will be unable to effectively duplicate the authorized user's signature 30.

Figure 5:
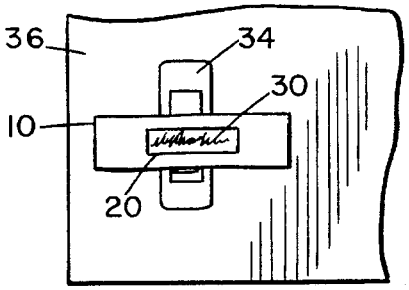
FIG. 5 is a front view illustrating use of the label to secure an on/off switch.

The label may be used in a number of different ways to prevent unauthorized tampering without the owner's knowledge. For example, it may be used to secure a door of a room, cabinet, or the like to prevent access to the area secured by the door without the owner's or authorized individual's knowledge. It may be used to secure a door of a car, for example, by placing the signed strip across the edge of the car door and door frame. It may also be used to prevent access to an on-off switch 34 of a piece of electronic equipment 36 such as a computer or the like, as illustrated in FIG. 5. When the signed strip is adhered tightly across the switch in the off position, no one can move the switch to the on position without first removing or peeling off the strip, so that the tamper indicating markings will become activated. Thus, unauthorized users cannot use the equipment without the owner's knowledge that tampering has occurred. If the authorized user wishes to use the equipment, he or she simply peels off and discards strip 20 and then applies anew, signed strip as needed.

The tamper indicating strip 10 may also be used to secure other items such as suitcases, briefcases, bags, jewelry boxes, and the like against unauthorized opening without the owner's knowledge. It may also be used to secure a personal notebook such as a diary, for example, by securing across the edge of the book to the front and back flap of the book. Similarly, it may be used to secure files containing sensitive or secret information by adhering it over the front and back of the file to prevent opening without first peeling away or tearing the strip. Unauthorized opening and possible copying of the file contents then cannot occur without leaving evidence of such opening.

Figure 6:
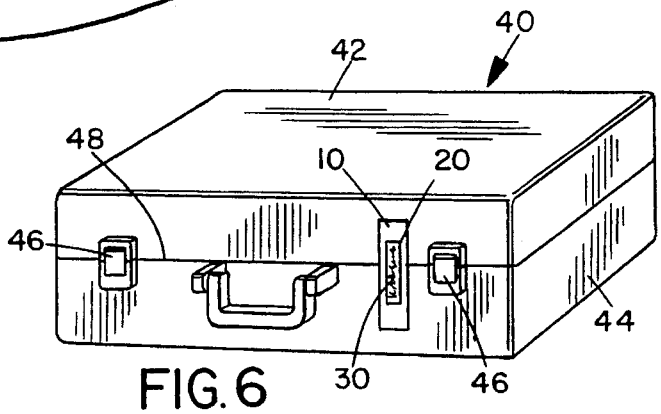
FIG. 6 is a perspective view illustrating use of the label to secure a case against unauthorized opening.

FIG. 6 illustrates another possible use of the strip to secure a briefcase 40. The lid 42 and base 44 of the briefcase are closed and secured in the normal way by latches 46, with their peripheral edges in engagement along junction 48. A strip 10 is signed in area 20 and is then adhered across junction 48 in any desired position, so that it adheres to portions of both the base and lid and the lid cannot be opened without peeling up or removing strip 10.

If the owner leaves the briefcase unattended with the strip 10 in place, it still cannot be opened without leaving immediate evidence of tampering. This will provide a significant deterrent to individuals opening the case, particularly in situations where only certain individuals would have had access to the case in the owner's absence.

The tamper indicating strip of this invention is less easily circumvented than a simple tamper indicating strip or label which is torn or produces tamper markings when lifted. The latter types of strip are of little value where unauthorized individuals can gain access to inactivated strips and may simply replace an activated strip after opening or using an item under protection. This is not possible with tamper indicating strip 10, which requires application of a personal signature by an authorized individual, preventing easy replacement and circumvention of the tamper indicating device.

Although a preferred embodiment of the present invention has been described above by way of example only, it will be understood by those skilled in the field that modifications may be made to the disclosed embodiment without departing from the scope of the invention, which is defined by the appended claims.

I claim:

1. A tamper indicating device for securing an item to be protected, comprising:

a multi-layer strip having an upper layer of at least partially transparent material, an indicia-forming layer, and a lower, adhesive layer for securing the strip to an item to be protected;

the upper layer including an imprintable signature area for receiving personal indicia and a non-imprintable area outside said signature area; and the indicia-forming layer comprising means for changing the appearance of said non-imprintable area of the strip irreversibly on lifting of the strip from a protected item to which it has previously been adhered.

2. The device as claimed in claim 1, wherein the upper layer is of transparent material, the indicia-forming layer comprises a tamper pattern and activating means for activating the pattern on removal of the strip from a protected item, and the imprintable signature area comprises a coating of imprintable material on the upper layer.

3. The device as claimed in claim 1, wherein the imprintable signature area comprises a layer of imprintable material covering only the signature area of said upper layer.

4. The device as claimed in claim 3, wherein said upper layer has at least one other area coated with imprintable material.

5. The device as claimed in claim 3, wherein the imprintable material is an imprintable varnish.

6. The device as claimed in claim 1, wherein the imprintable signature area extends across the center of the strip.

7. The device as claimed in claim 6, wherein the signature area is at least 2 inches in length.

8. The device as claimed in claim 1, wherein the non-imprintable area completely surrounds said signature area.

9. The device as claimed in claim 1, wherein the imprintable signature area extends across the center of the strip and has opposite ends spaced from the respective opposite ends of the strip, the non-imprintable area including non-imprintable end portions extending from each end of the signature area to the respective end of the strip.

10. The device as claimed in claim 9, wherein each end portion has a length approximately equal to the length of the signature area.

11. A tamper indicating device for securing an item to be protected against unauthorized tampering without the user's knowledge, the device comprising:

a multi-layer strip having a first layer of at least partially transparent material, the first layer having an upper surface and a lower surface, a second layer of adhesive material for securing the strip to an item to be protected, and a tamper pattern-forming layer between the lower surface of the first layer and the second layer, whereby after the strip is adhered to an item, the tamper pattern is activated on removal of the strip from the item and is visible through the upper layer after activation; and the upper layer having at least one signature area for receiving a signature imprint, the signature area extending over at least part of the upper layer.

12. The device as claimed in claim 11, wherein the signature area comprises a cover portion of imprintable material for receiving personal indicia, the cover portion covering part of the upper surface of the upper layer.

* * * * *